US005086944A

United States Patent [19]

Duffy et al.

[11] Patent Number: 5,086,944

[45] Date of Patent: Feb. 11, 1992

[54] DRUM OR PAIL CLOSURE

[75] Inventors: Douglas C. Duffy, West Ryde; Richard D. Temby, Woodville West, both of Australia

[73] Assignee: Rheem Autralia Ltd., Australia

[21] Appl. No.: 235,107

[22] Filed: Aug. 22, 1988

Related U.S. Application Data

[62] Division of Ser. No. 893,790, Aug. 6, 1986, Pat. No. 4,938,051.

[30] Foreign Application Priority Data

Dec. 7, 1984 [AU] Australia ..... PG8469
Sep. 30, 1985 [AU] Australia ..... PH2676

[51] Int. Cl.[5] ..... B65D 41/10

[52] U.S. Cl. ..... 220/658; 220/309; 220/310; 220/610; 220/614

[58] Field of Search ..... 220/309, 310, 610, 614, 220/658, 319, 320, 321

[56] References Cited

U.S. PATENT DOCUMENTS

| | | | |
|---|---|---|---|
| 1,929,375 | 10/1933 | Shanor et al. | 220/320 |
| 2,205,685 | 6/1940 | Conner | 220/310 |
| 3,448,891 | 6/1969 | Czarnecki | 220/658 |
| 3,510,023 | 5/1970 | Ullman et al. | 220/308 |
| 4,113,133 | 9/1978 | Berthet | 220/658 |
| 4,344,546 | 8/1982 | Dry | 220/320 |
| 4,651,892 | 3/1987 | Boersma | 220/320 |

*Primary Examiner*—Stephen Marcus
*Assistant Examiner*—Nova Stucker
*Attorney, Agent, or Firm*—Flehr, Hohbach, Test, Albritton & Herbert

[57] ABSTRACT

The invention comprises a drum having a top rim formed as an outwardly rolled curl. The curl is rolled through at least 450 degrees with respect to the cylindrical wall of the drum and does not contact any uncurled portion of the body of the drum.

19 Claims, 10 Drawing Sheets

DRUM OR PAIL CLOSURE

This a divisional of 06/893,790, filed Aug. 6, 1986 U.S. Pat. No. 4,938,051 which is a continuation of PCT application Ser. No. PCT/AU85/00309, filed Dec. 9, 1985 and published as WO86/03477, June 19, 1986 which list the United States as a designated country.

TECHNICAL FIELD

This invention relates to a closure for a sheet metal pail or drum and has been devised particularly though not solely as an improved top rim for an open head pail or drum, enabling a cover to be attached thereto in a manner giving a superior performance in dangerous goods testing, including drop testing.

BACKGROUND ART

Sheet metal drums or pails of cylindrical configuration generally fall into two main categories, namely open head pails or drums, and closed head pails or drums. Closed head drums normally have a permanently fastened top or head incorporating a small threaded closure of approximately 50 mm diameter through which the liquid contents of the drum may be discharged. By way of comparison open head drums, variously called open head, full open head, full open top or removable top, have a large circular removable lid which is engaged with a rim around the upper periphery of the cylindrical part of the drum. While closed head drums are suitable for the carriage of low viscosity liquids which may be easily poured into, and pumped or poured from the small closure in the lid of the drum, it is preferred to use open head drums for the carriage of viscous liquids such as adhesives or paints, and also for the carriage of granular solids.

Sheet metal drums or pails are commonly required for use in the transport of dangerous goods for which the leak tightness of the container as a whole, and especially the closure region, must be tested for approval by design-type qualification testing. The leak tightness of dangerous goods containers must be capable of being preserved, even in situations where the closure is severly and permanently deformed by impact or internal pressure. Drop testing is commonly carried out by dropping a laden container from a prescribed height onto a hard surface in various different orientations such that the container must survive being dropped onto its side, its lid, or at an angle where the upper rim of the container first contacts the ground surface at a prescribed angle. Such forms of testing for dangerous goods containers have recently been made considerably more stringent in various jurisdictions and it has been suggested that conventional open head drums will no longer be permitted for the storage and/or carriage of many categories of dangerous goods for which they have been in wide use for some considerable time.

Many solids and liquids are categorized as dangerous goods. Many liquid paints and adhesives, for example, are so categorized because inflammable components are used in their formulation. It has therefore become a need felt by purchasers and users of open head type drums for an improvement in the construction of the closure region so that this type of drum or pail can continue to be approved by the appropriate authorities for the storage and/or transportation of those dangerous goods for which they have existing market acceptance.

It is also commercially desirable that such improvements to the closure region of an open head drum or pail be achieved with not more than a small incremental cost increase to the existing, market accepted, drums or other similar types of container.

It is therefore an object of the present invention to provide a cylindrical open head sheet metal pail or drum which will obviate or minimise the foregoing disadvantages or which will go at least part of the way toward meeting the foregoing desiderata in a simple yet effective manner, or which will at least provide the public with a useful choice.

DISCLOSURE OF INVENTION

The present invention derives from a realisation that the integrity of the seal of the closure of an open head pail or drum can be improved by strengthening the curl at the rim, which not only resists deformation of the rim during drop testing, but also enables a superior clench to be achieved when securing the lid to the pail or drum, without collapsing the curl.

Accordingly in one aspect the invention consists in a method of forming an outwardly rolled curl as the top rim of a cylindrical open head sheet metal pail or drum, said method comprising the steps of forming a primary curl in the rim by pressing or rolling the top peripheral edge, and then forming a secondary curl of larger cross-sectional diameter as a continuation of the primary curl by pressing or rolling, the primary curl being at least partially contained within the secondary curl such that the peripheral edge is curled or rolled through at least 360° with respect to the cylindrical wall of the pail or drum.

In a further aspect the invention consists in a cylindrical open head sheet metal pail or drum having a top rim formed as an outwardly rolled curl wherein the upper peripheral edge of the sheet metal has been curled or rolled outwardly through at least 360° with respect to the cylindrical wall of the pail or drum.

In a further aspect the invention consists in a sheet metal lug-cover lid for a pail or drum, said lid incorporating a plurality of lugs extending downwardly from the periphery of the lid adapted to be clenched beneath the rim of a pail or drum, characterised by the shape of each lug incorporating substantially parallel side edges.

Figure 1:
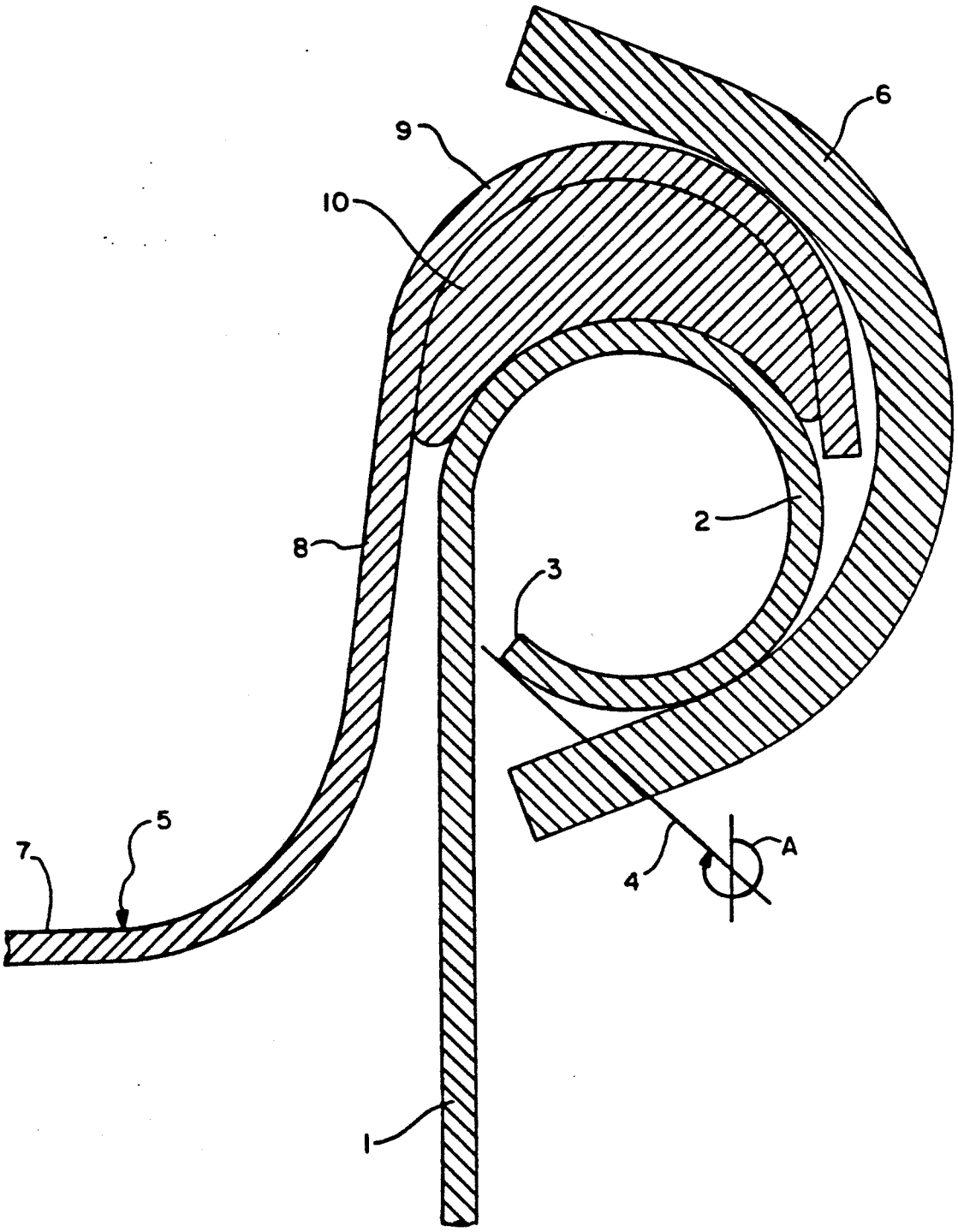
PRIOR ART FIG.-1
FIG. 1 is a cross-sectional scrap elevation through the upper rim of a conventional (prior art) open head drum showing a lid held in place by a clamping ring.
Figure 3:
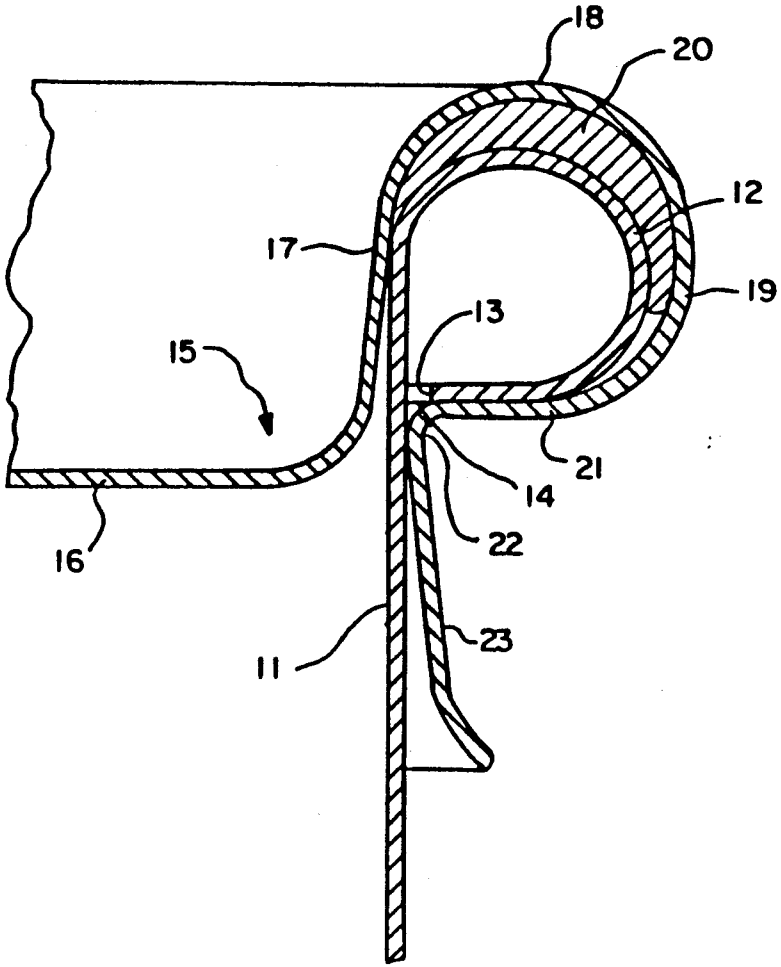
PRIOR ART FIG.-3
FIG. 3 is a cross-sectional scrap elevation of the uper rim of an alternative form of prior art pail to that shown in FIG. 2, showing a lug cover clenched in position.
Figure 2:
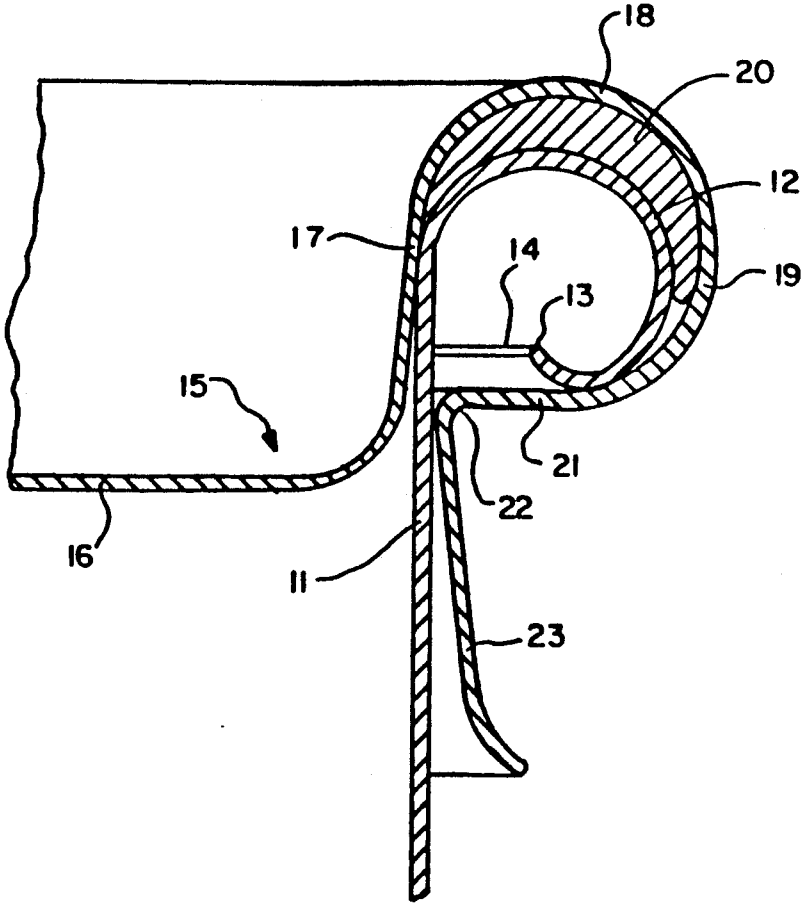
PRIOR ART FIG.-2
FIG. 2 is a cross-sectional scrap elevation of the upper rim of a prior art pail showing a lug cover clenched in position.

Referring firstly to FIGS. 1, 2 and 3 which show the various forms of prior art drum or pail closures, there is shown in FIG. 1 a cross-section through the cylindrical wall (1) of a sheet metal drum having an upper rim formed by a curl (2) terminating in a peripheral edge (3). The peripheral edge (3), at which the curl (2) terminates, is normally within one or two metal thicknesses of the cylindrical wall (1). During the formation of the curl (2) an imaginary line (4) extending generally tangentially with respect to the curl (2) adjacent its peripheral edge (3) and arranged initially co-linearly with the wall (1), is rotated through an angle, as illustrated by the arrow A, of typically 250° to 320°.

The drum is also typically provided with a lid (5) held in place by a separate locking ring (6). The lid typically comprises a flat disc-like section (7), an upwardly extending flange (8) and a rim (9) adapted to seat over the curl (2) at the rim of the drum (1). A resilient gasket (10) is normally provided within the rim (9) to fill the space between the rim (9) and the curl (2) so that when the gasket is compressed against the curl (2) leakage of contents from within the drum is prevented. The tight compression of the gasket (10) and the retention of the lid on the drum is effected by the application of opposed forces to the lid rim (9) and the curl (2) by a locking ring (6) which is split radially, usually at one point, and tensioned such as to tend to close the split therein by the action of either a bolt and nut or other suitable arrangement such as a lever mechanism. The bolt and nut or lever mechanism, as the case may be, each act via appropriate fixtures attached securely to either side of the radial split in the locking ring (6). Locking rings of this type are commonly used for large sheet metal drums whereas smaller pails typically are provided with "lug-cover lids" of the type which will now be described with reference to FIGS. 2 and 3.

In FIGS. 2 and 3 there is shown the cylindrical sheet metal wall (11) of a pail having an upper rim formed by a curl (12) terminating in a peripheral edge (13). As was the case for the drum described with reference to FIG. 1, the peripheral edge (13) is rotated through an angle of substantially less than 360° when forming the curl (12). This is due to limitations in known manufacturing technique for the formation of curls on the rims of drums or pails, which also result in the formation of gap (14) between the peripheral edge (13) and the cylindrical wall of the pail (11).

The lug-cover lid (15) typically has a flat disc-like portion (16), an upwardly extending flange (17) and an outwardly curled rim (18). Before the lug-cover lid is clenched in place on the rim of a pail, the skirt of the rim typically depends downwardly from point (19) of the rim and may be formed to a number of different lug configurations as typically shown in FIGS. 12 and 13. Once again a resilient gasket (20) is provided within the rim of the lid in a similar manner to the gasket (10) described with reference to FIG. 1.

In use once the lid has been placed on the rim of the pail, the skirt or lug portion (21) is clenched inwardly beneath the curl (12) [using a suitable clenching machine] so that the lugs are bent through an angle (22) and depend downwardly in portion (23) adjacent to the cylindrical wall (11) of the pail.

MODES FOR CARRYING OUT THE INVENTION

Notwithstanding any other forms that may fall within its scope, one preferred form of the invention and variations thereof will now be described by way of example only with reference to FIGS. 4 to 11 and 14 of the accompanying drawings.

The preferred form of the invention will be described with reference to the formation of the curl in the rim of an open head pail of the type adapted to receive a lug-cover lid. It will be appreciated however that similar curls can be formed in either pails or drums of any size adapted to be used with other lid configurations and other lid-to-drum attachment means (such as that shown in FIG. 1).

Figure 4A:
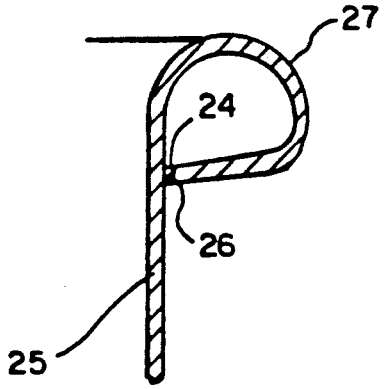
FIGS. 4A to 4E are cross-sectional scrap elevations showing the forming of a curl in the upper rim of a pail or drum according to the invention.
Figure 4B:
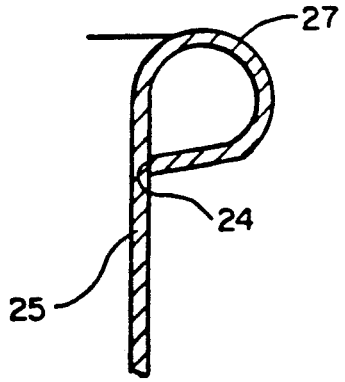

A unique feature of the present invention is the formation of the curl at the rim of the pail by curling or rolling the free peripheral edge of the sheet metal cylinder through at least 360° with respect to the cylindrical wall of the pail. This operation will now be described with reference to FIGS. 4A to 4E. As shown in FIG. 4A the peripheral edge (24) is first curled or rolled in a substantially circular cross-sectional shape through an angle of 270° with respect to the cylindrical side wall (25), leaving a small gap (26) between the outer surface of the side wall (25) and the peripheral edge (24) of the rim. The formation of the curl to this stage is substantially the same as the formation of the prior art pail curl shown in FIG. 3. The effective cross-sectional diameter of the primary curl shown in FIG. 4A is preferably smaller than the intended effective cross-sectional diameter of the curl when fully formed.

The next step in the formation of the curl in the rim of the pail is optional but has been found to result in a superior curl in certain pail sizes and wall thicknesses. The second step, shown in FIG. 4B, involves increasing the diameter of the pail in its upper region, so that the pail is provided with an inward taper in the downward direction thereof and such that the outer surface of the side wall (25) moves towards, or even contacts the peripheral edge (24) of the primary curl (27). In this manner the small gap (26) which resulted from the formation of the primary curl (27) is reduced or eliminated.

Figure 4C:
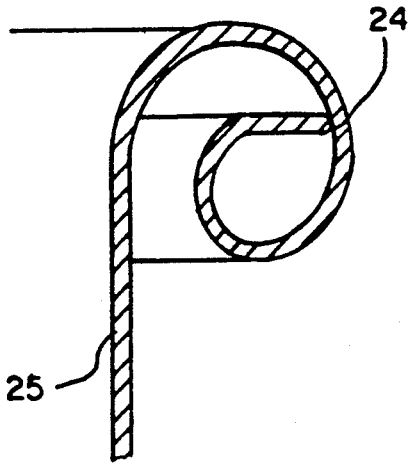
Figure 4E:
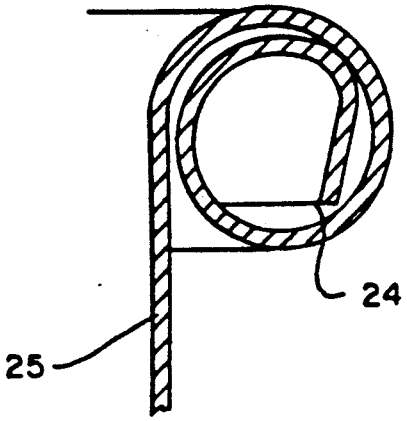
Figure 4D:
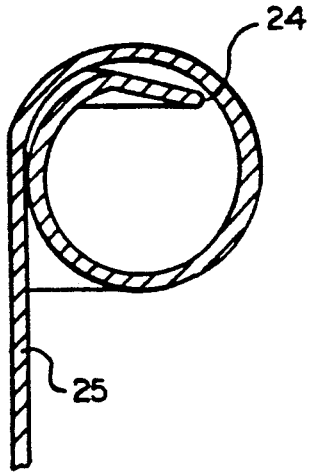

FIGS. 4C to 4E show three additional and subsequent stages of formation of the curl wherein the free edge (24) is rotated even further with respect to the side wall (25) to angular extents of up to approximately 540° as shown in FIG. 4E. The actual extent of the curl can be made dependent upon the particular application of the pail or other type of container. In accordance with the invention, however, the curl of the rim is at least 360° with respect to the side wall (25).

The curl of the general type shown in FIGS. 4D and 4E may be achieved by any combination of known rolling or pressing processes but is preferably formed in a two stage operation wherein the primary curl is formed in the rim by pressing or rolling and then a secondary curl of larger cross-sectional diameter is formed as a continuation of the primary curl either by pressing or rolling, resulting in a composite curl which in total extends through at least 360° and preferably through at least 450° to as much as 540° or more, forming a very strong and rigid rim of the type necessary to maintain structural integrity during drop and other performance tests conducted on the closed pail. Two methods of forming the curl will now be described with reference to FIGS. 5 and 6.

Figure 5B:
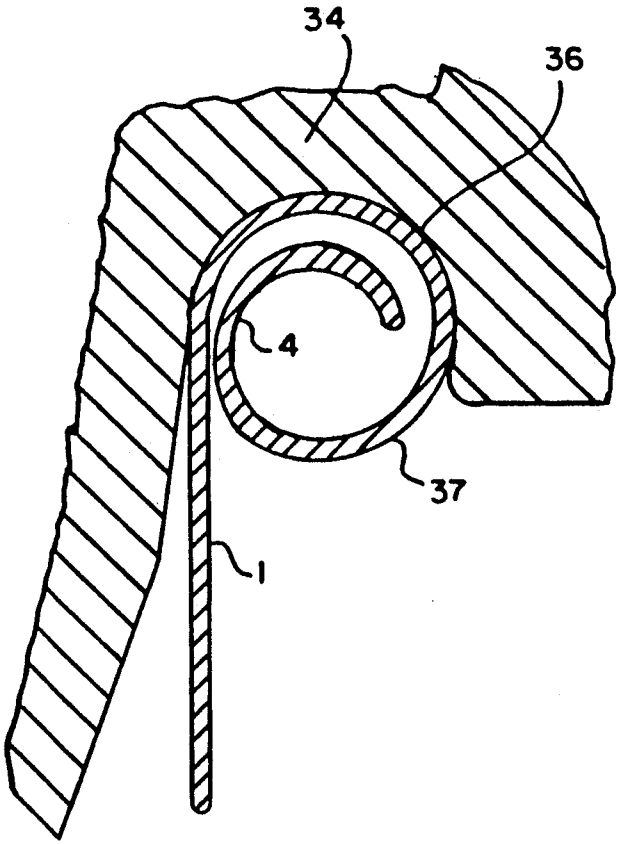
FIG. 5B is a similar view to FIG. 5A showing the press operation into a die forming a secondary curl in the rim.
Figure 5A:
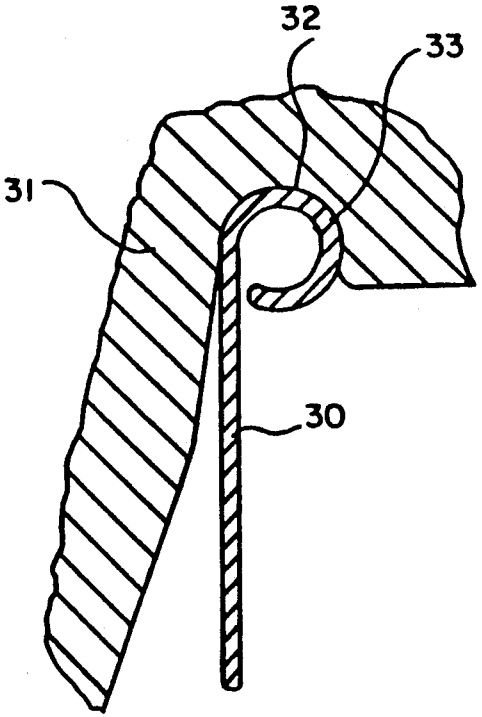
FIG. 5A is a cross-sectional scrap elevation of the rim of a pail showing the formation of a primary curl during a pressing operation into a die.

In a first form of the invention the curl is formed by pressing the pail in a longitudinal direction into dies of the configuration shown in FIGS. 5A and 5B. The dies are generally trough-like in configuration being circular in plan view and having cross-sections as shown in shaded outline in FIGS. 5 and 6. In the first phase of the operation the circumferential wall (30) of the pail is pressed longitudinally into a die (31) having a groove (32) formed therein. The groove is semi-circular or substantially semi-circular in cross-section with the diameter of the semi-circular section corresponding with the intended cross-sectional diameter of the primary curl (33) which it is desired to form. By pressing the pail body longitudinally into a die of this configuration the peripheral edge of the rim is caused to curl outwardly and back on itself through approximately 270° as shown in FIG. 5A.

The secondary curl is then formed by taking the pail with the primary curl and pressing it into a die (34) as shown in FIG. 5B having a similar configuration groove (36) of a larger cross-sectional semi-circular diameter corresponding to the cross-sectional diameter of the finished curl it is desired to form in the rim of the pail. In this manner the curl is further rolled so that the primary curl (33) is now contained within the secondary larger curl (37). In this manner the peripheral edge of the rim is typically rolled through 540° forming a curl of the configuration shown in FIG. 5B.

As a preferred step in forming the curl in FIG. 5B the open mouth of the pail may be expanded in diameter between the formation of the primary curl shown in FIG. 5A and the secondary curl shown in FIG. 5B. This expansion serves to tighten the primary curl and to tuck under the leading edge of the rim which then bears against the outer diameter of the body (30) of the pail.

Figure 6A:
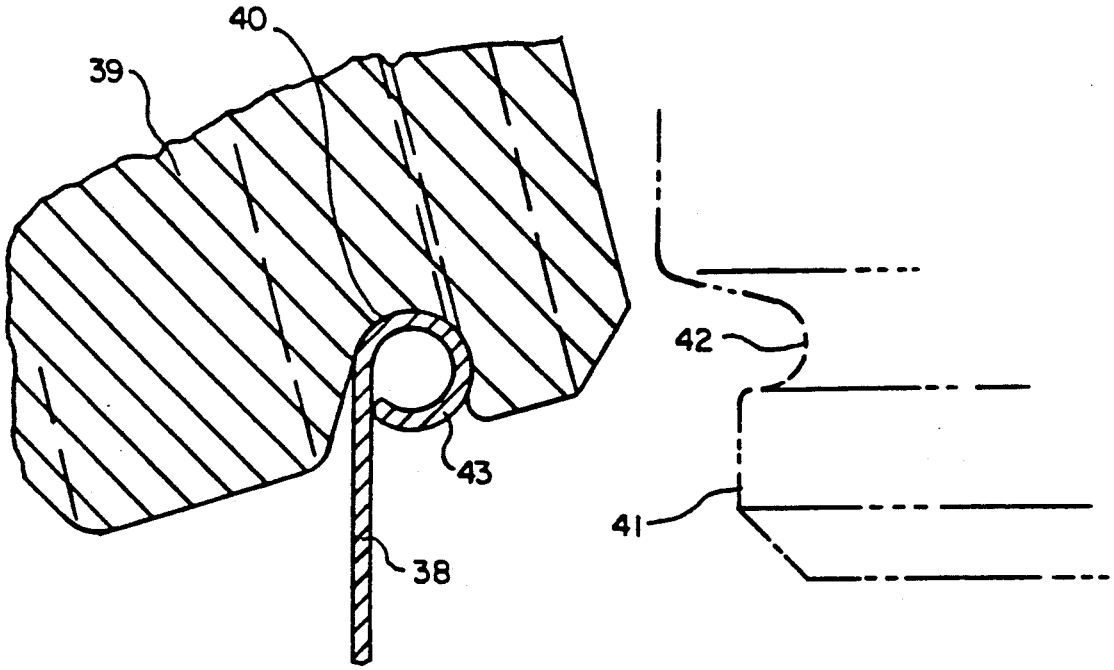
FIG. 6A is a cross-sectional scrap elevation of the rim of a pail showing the formation of a primary curl in a rolling operation.

In an alternative form of the invention the curl is formed by rolling rather than by pressing as will now be described with reference to FIGS. 6A and 6B. Once again the curl is formed in stages so that a primary curl having a comparatively small diameter is formed first, followed by a secondary curl of larger cross-sectional diameter as a continuation of the primary curl. Once again the mouth of the pail may be preferably expanded between the formation of the primary curl and the secondary curl.

In the rolling formation of the curl the peripheral edge of the rim of the circumferential wall (38) of the pail is rolled outwardly by the operation of a first set of rollers (39), each having a circumferential groove (40) of a predetermined cross-sectional radius. The head carrying the rollers in FIG. 6A is moved substantially longitudinally on the rim of the pail to cause the rim to curl outwardly. The primary curl formation may be further assisted by a second set of rollers (41) which are moved substantially radially inwardly as indicated in FIG. 6A. The second rollers also have circumferential grooves (42) which may be of slightly smaller cross-sectional diameter than the cross-sectional diameter of the groove (40) in the roller (39). Once the primary curl has been further formed by the second roller (41) (if used) the second roller is retracted and the first roller (39) once again advanced longitudinally to complete the formation of the primary curl to the configuration (43) shown in FIG. 6A.

Figure 6B:
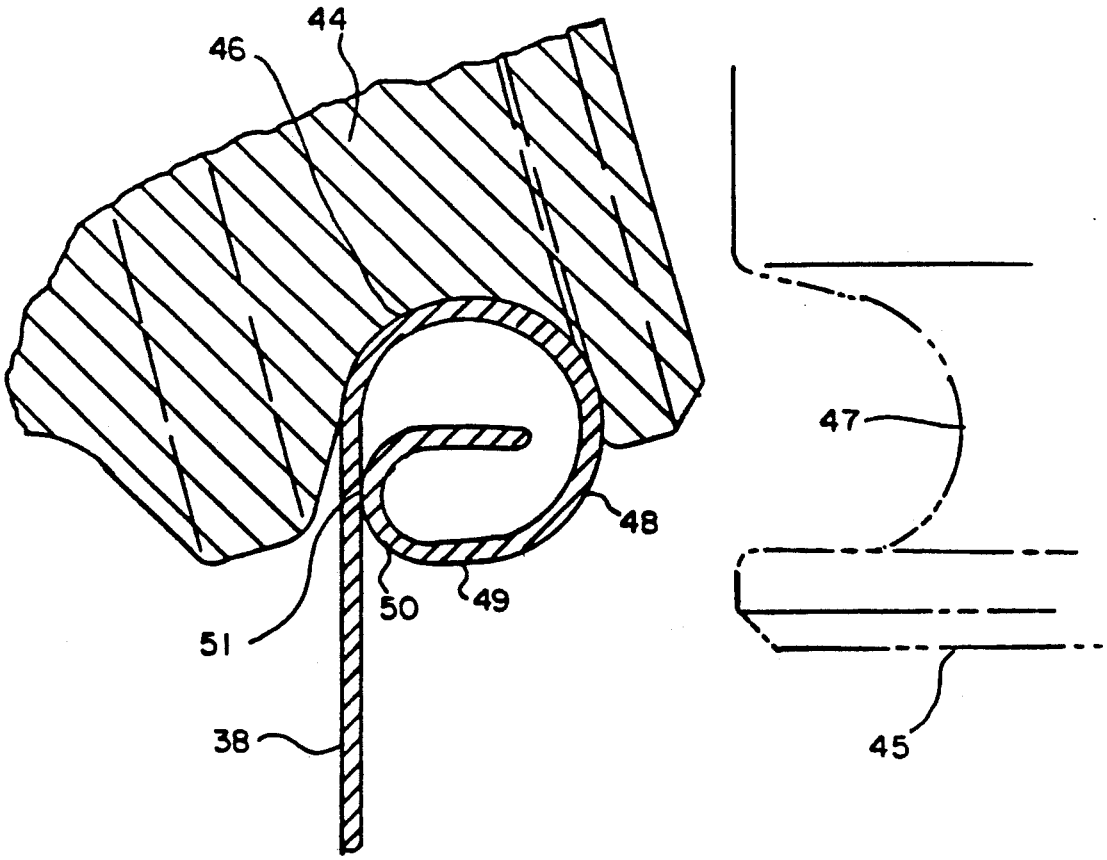
FIG. 6B is a similar view to FIG. 6A showing the second phase of forming the secondary curl of the rim of a pail during a rolling operation.

Referring to FIG. 6B, the secondary curl is similarly formed by a second set of rollers comprising a first roller (44) and a second roller (45) similar in configuration and positioning to the rollers (39) and (40) used in forming the primary curl, except that the circumferential groove (47) preferably has a slightly smaller cross-sectional radius than groove (46). Once again the secondary curl is formed by a first rolling operation from the first roller (44) followed by a second rolling operation from the second roller (45) and completed by a final rolling operation from the first roller (44).

The overall rolling operation forms a curl of the configuration shown in FIG. 6B wherein the secondary curl (48) of larger cross-sectional diameter rolls outwardly from the body (38) of the pail through approximately 270° to a point (49) whereupon the curl continues into the primary curl (50) which extends through approximately 180° or more and has a nose portion (51) abutting or close to the circumferential wall of the pail (38).

Pails with curls of the configuration shown in either FIG. 5B or FIG. 6B may be utilised for engagement with a lug-cover lid as can be seen in FIGS. 7A, 7B, 8, 9 and 10.

Figure 7B:
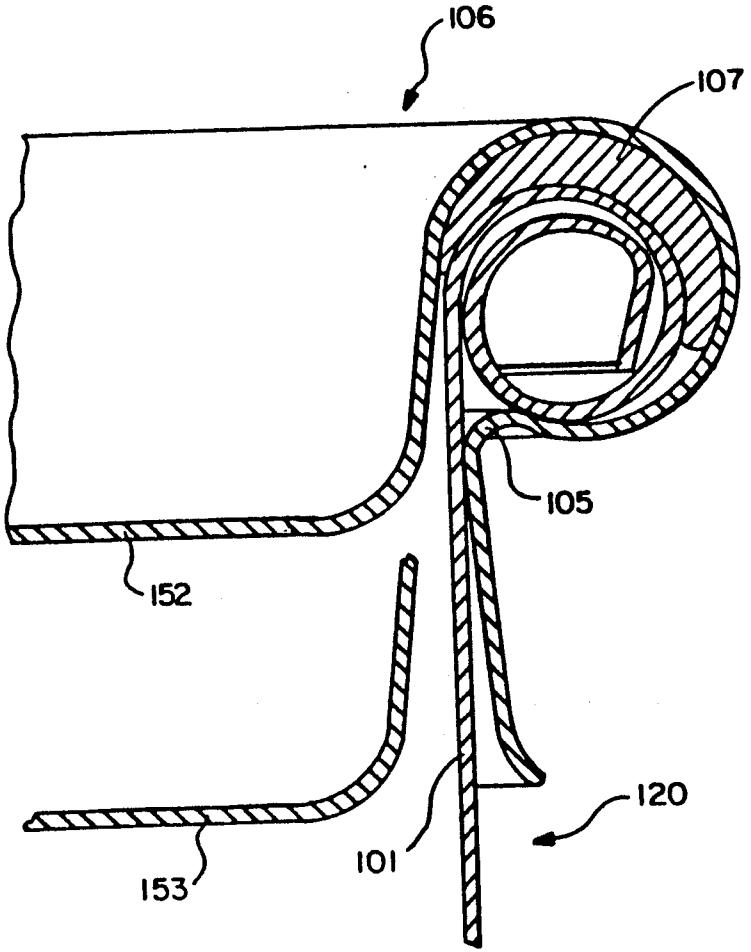
FIG. 7B is a similar view to FIG. 7A showing the lug cover clenched in place.
Figure 7A:
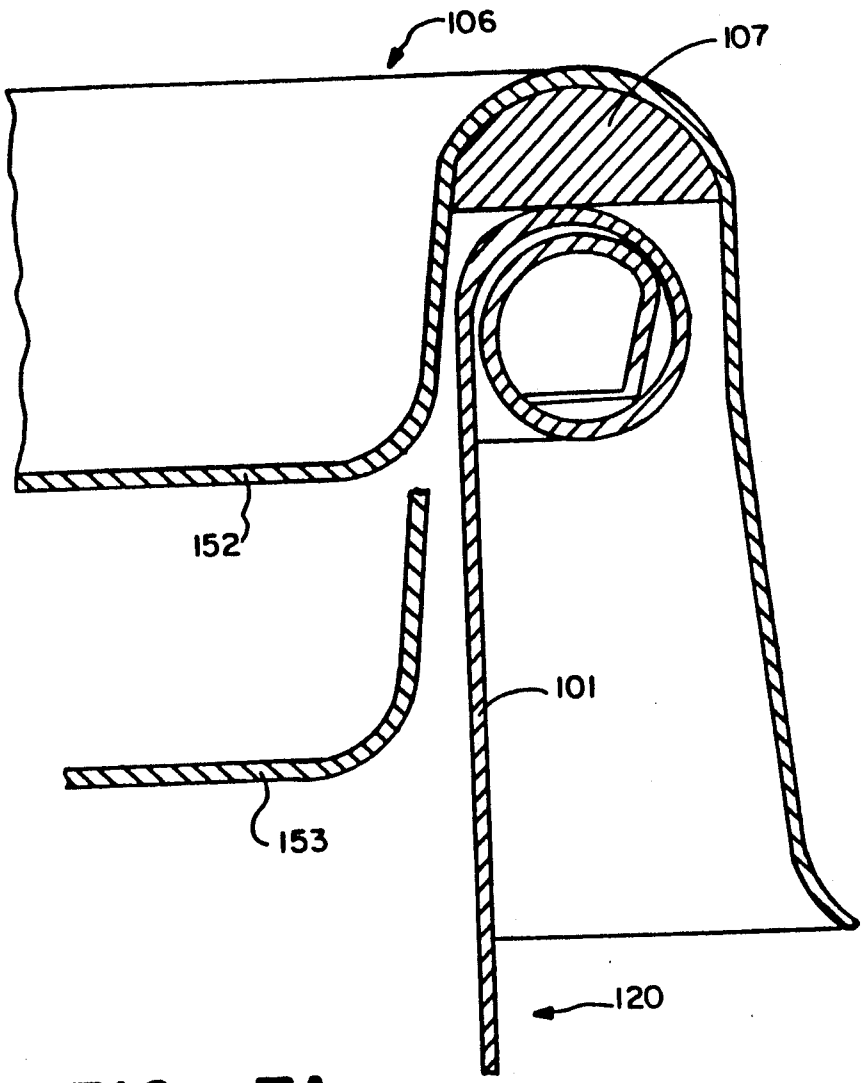
FIG. 7A is a cross-sectional scrap elevation of the upper rim of a pail according to the invention showing a lug cover sitting loosely in place on the rim before clenching.

In FIG. 7A, the lid (106) is shown prior to its attachment to the pail (120), with its peripheral lugs extending downwardly and with the resilient gasket (107) in position. In securing the lid (106) to the curled or rolled rim of the pail (120), as shown in FIG. 7B, its periphery is shaped around the lower portion of the pail rim such that an arcuate portion of the lid periphery extends slightly upwardly into a generally inverted V-shaped recess defined between the rim and sidewall (101). This portion (105) ensures that the lid (106) is securely attached to the pail (120), whereby the regulatory drop tests discussed above can be fulfilled satisfactorily. The resilient gasket (107) assumes its conventional position between the arcuate periphery of the lid (106) and the upper portion of the curled or rolled rim of the pail or drum (101).

As in the case of the prior art arrangements discussed earlier in relation to FIGS. 2 and 3, the central portion (152) of the lid is located just below the level of the bottom portion of the curled or rolled rim. However, a further embodiment in accordance with the invention provides a deeper nose, as indicated, generally at (153), which extends downwardly inside the pail (120) to a greater extent than the nose with the central portion (152). It has been found that an increased depth of nose from approximately 11 mm to a depth in the range of 17 mm to 25 mm and more preferably 19 mm to 22 mm, when the central portion of the lid (152) is completely planar, is particularly advantageous for pails of capacities in the range of 10 liters to 25 liters. This further inventive feature provides additional security for the lid, particularly when the filled pail is subjected to the regulatory drop tests.

Alternative configurations of curl and the corresponding lug-cover lids will now be briefly described with reference to FIGS. 8, 9 and 10.

The pail body (52) with its curl (53) is closed by a lug-cover lid having a dished cover portion (54) of deep draw (deep nose) configuration having a deep side wall (55) rolled over to a rim (56) in which is positioned a gasket (57). The rim extends downwardly in lugs (58) which are adapted to be clenched under the curl of the pail to secure the lid on the pail as will now be described. Before clenching, the lugs (58) extend downwardly from the rim (56) such that the lid may be easily placed in firmly fitting relationship with the pail. Once in position a clenching machine is engaged with the lugs such that each jaw of the tool head forces the lugs inwardly and upwardly with a force finally applied in the direction of arrow (59) so that the lugs are deformed inwardly against the wall of the pail (52) and tucked upwardly so as to form a re-entrant angle (60) between the curl (53) and the peripheral wall (52) of the pail. During the clenching operation the gasket (57) which was previously positioned within the rim (56) on top of the curl is compressed and tends to be forced outwardly and downwardly towards position (61). This positioning of the gasket material has been found to be particularly beneficial in maintaining the integrity of the seal between the lid and the pail during drop and other performance testing.

It has also been found that the clenching of the lugs inwardly and upwardly to form the re-entrant angle (60) is beneficial in retaining the cover in place on the pail during severe testing. Conventional prior art lug-cover lids are normally clenched in place so that the lugs simply extend inwardly at right angles to the circumferential wall (52) of the pail forming a comparatively weak mechanical join as shown in FIGS. 2 and 3. It is a feature of the invention that the superior curl formed by rolling the rim of the pail through more than 360° enables a much higher clenching force to be applied to the lug without collapsing the curl on the pail, and therefore allows the re-entrant clenching of the lug up and between the curl and the adjacent cylindrical wall of the pail.

Figure 8:
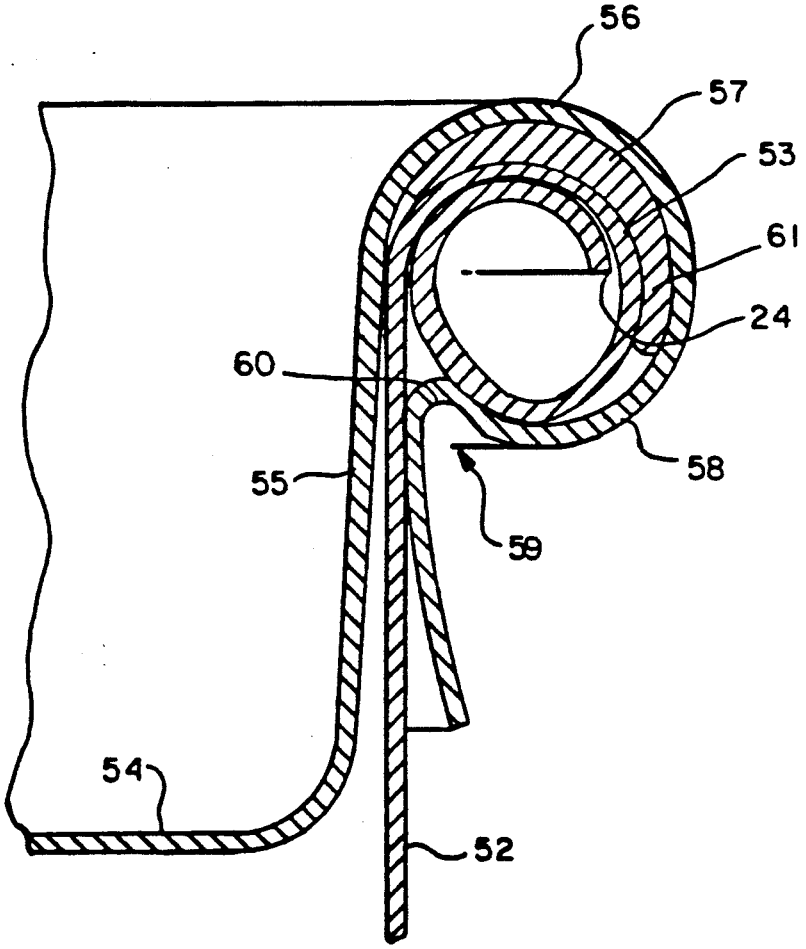
FIG. 8 is a cross-sectional scrap elevation of the upper rim of a pail according to the invention showing a lug cover clenched in place.

It will also be noted when comparing the curl configurations shown in either FIG. 5B or FIG. 6B with the finished curl shown in FIG. 8 after crimping of the lug-cover lid in place, that the final tightening and forming of the curl to the configuration shown in FIG. 8 may be achieved during crimping of the lug-cover lid in place on the pail. In this case the clenching machine performs the third stage in the formation of a tightly rolled curl of the configuration shown in FIG. 8. The tightly rolled curl can also be formed by either of the methods described, without necessarily relying on the crimping tool performing a third stage.

By varying the pressing and or rolling operations of the type previously described with reference to FIGS. 5 and 6, curls of different configuration are able to be formed. Two possible alternatives are shown in FIGS. 9 and 10 respectively which are similar to the configuration shown and described with reference to FIG. 8 apart from the shape of the actual curl. It has been found desirable to form the curl to a slightly oval configuration wherein the depth of the curl (parallel to the longitudinal axis of the drum) is slightly greater than the width of the curl (in the direction of the drum diameter). It has been found that a ratio of 5 to 4 between the curl depth to width respectively results in a particularly suitable strong curl which is effective in withstanding severely deforming tests performed on the closed pail, although a curl of circular cross-section will provide very satisfactory results.

Figure 11:
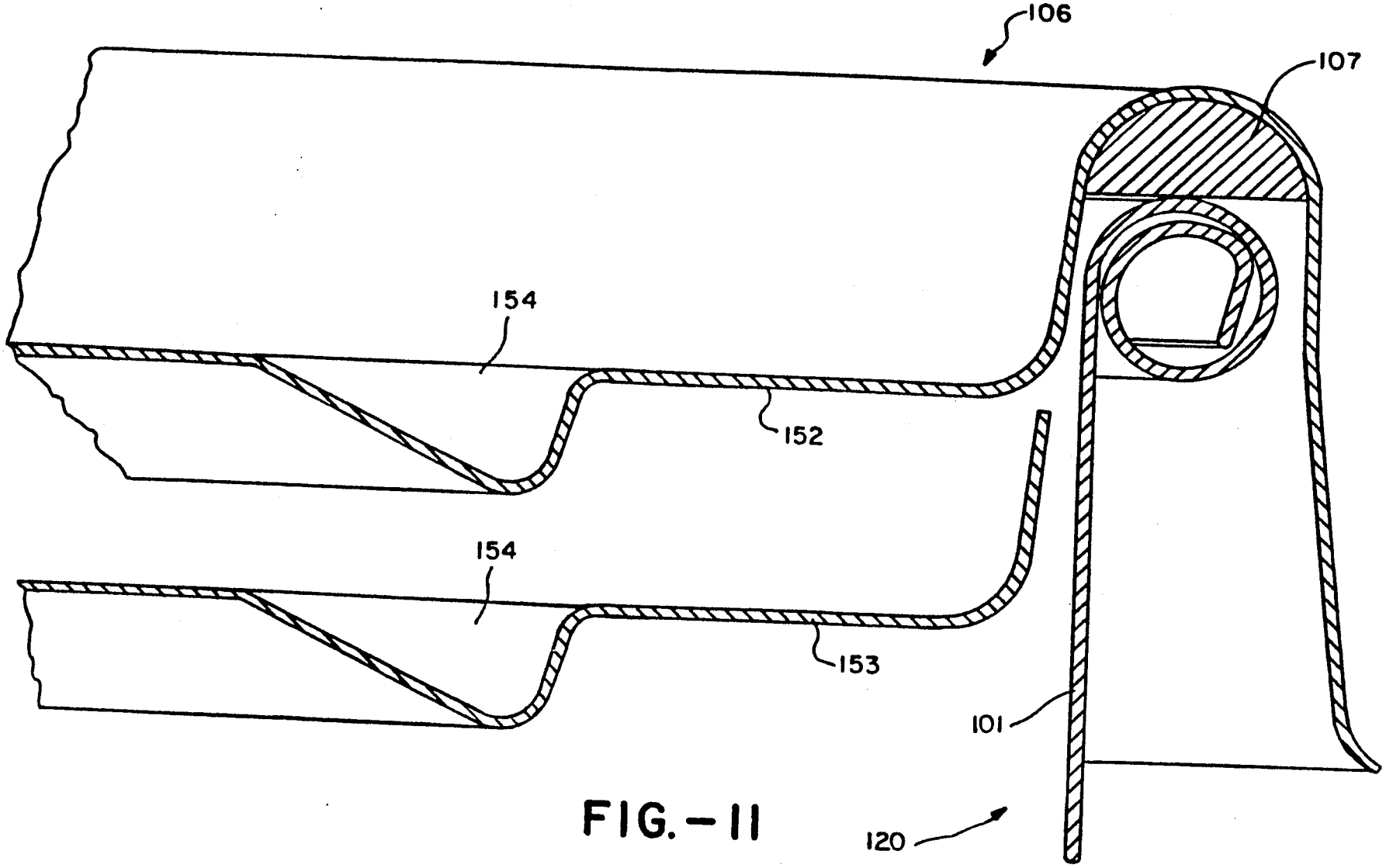
FIG. 11 is a cross-sectional scrap elevation of the upper rim of a pail according to the invention showing different configurations of lid before clenching.

FIG. 11 shows yet a further embodiment of the invention, in that the lid (106), whether it be of a shorter or longer nose type, is provided with a generally V-shaped annular groove (154) extending around the respective central portion (152) or (153). Again, however, the top rim of the side wall (101) has been rotated through approximately 540°. It is to be appreciated that, although the lid (106) shown in FIG. 11 has yet to be actually secured to the pail (120), such securement can, preferably, be in accordance with that described above in relation to FIG. 7B. It has been found in drop testing that the annular groove (154) can assist in retaining the integrity of the seal between the gasket (107) and the curl on the rim of the pail by obviating the "edge thrust" of the lid (152) or (153) against the rim area.

Figure 12:
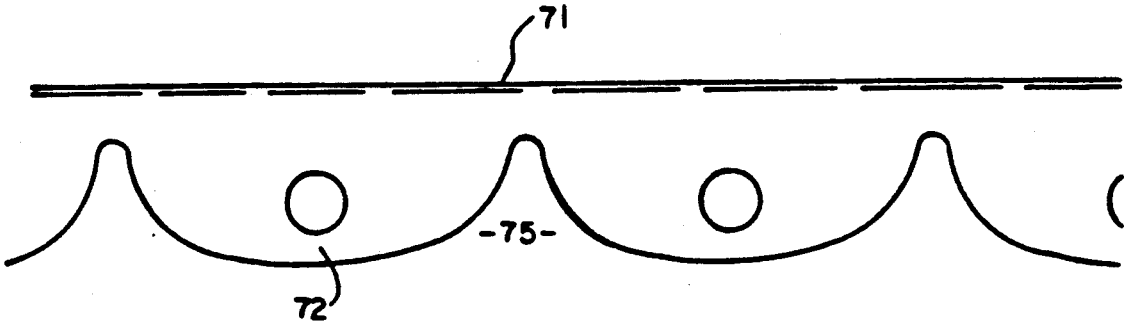
PRIOR ART FIG.-12
FIGS. 12 and 13 are partial elevations of the lugs commonly used in lug cover lids according to the prior art.
Figure 13:
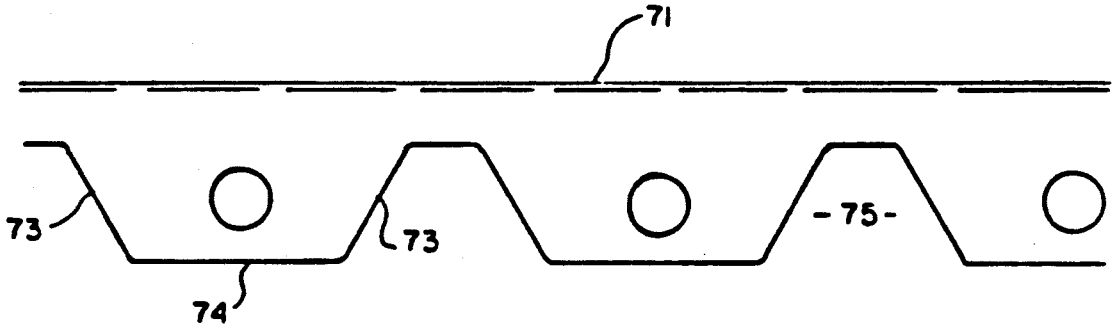
PRIOR ART FIG.-13

It is a further feature of the invention that the lugs of the lug-cover lid are formed to a particular configuration to maximise the strength of the clench of the lugs onto the curl of the pail. FIGS. 12 and 13 show the configuration of typical prior art lugs wherein in FIG. 12 the lugs depend downwardly from the rim (71) in a semi-circular shape (72) and in FIG. 13 the lugs have sloping sides (73) terminating in a flat lower edge (74). Both of these configurations have comparatively large gaps (75) between the lugs which significantly reduces the amount of metal around the periphery of the curl after the clenching operation.

The typical prior art lug configurations shown in FIGS. 12 and 13 also typically provide sixteen lugs around the periphery of the cover.

It has been found that by increasing the number of lugs from sixteen to between eighteen and twenty-two, and preferably to twenty and altering the configuration of the lugs it is possible to achieve a superior lug-cover configuration better able to maintain its integrity with the pail during severe testing. The increase in the number of lugs from sixteen to twenty makes it easier to provide a deep draw cover (153) having a deep nose (FIG. 7A). When manufacturing deep drawn covers provided with lugs of the type shown in FIGS. 12 and 13, problems can arise from the bunching and severe distortion of the metal at the intersections between the lugs. By increasing the number of lugs from sixteen to twenty the metal is better distributed and the problem ameliorated.

Figure 14:
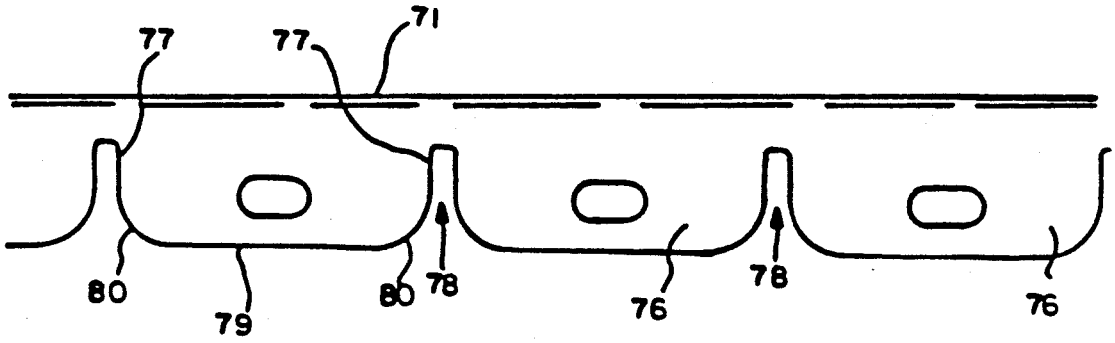
FIG. 14 is a view similar to FIGS. 12 and 13 showing the configuration of the lugs of a lug cover lid according to the invention.

In the lug configuration according to the invention as shown in FIG. 14 each lug (76) extends downwardly from the rim (71) of the lid and has a profile shape with parallel downwardly extending sides (77) spaced from the sides of the adjacent lugs by a parallel sided gap (78) of predetermined width. The lugs are typically provided with a straight lower edge (79) joined to the sides (77) by radiused corners (80).

Figure 9:
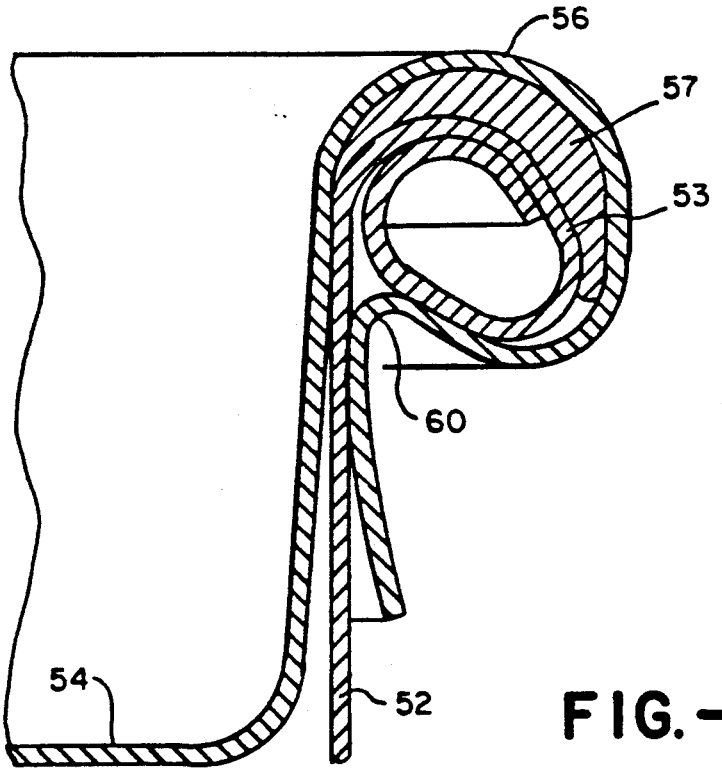
FIGS. 9 and 10 are similar views to FIG. 8 showing alternative forms of the curl formed in the rim of the pail.
Figure 10:
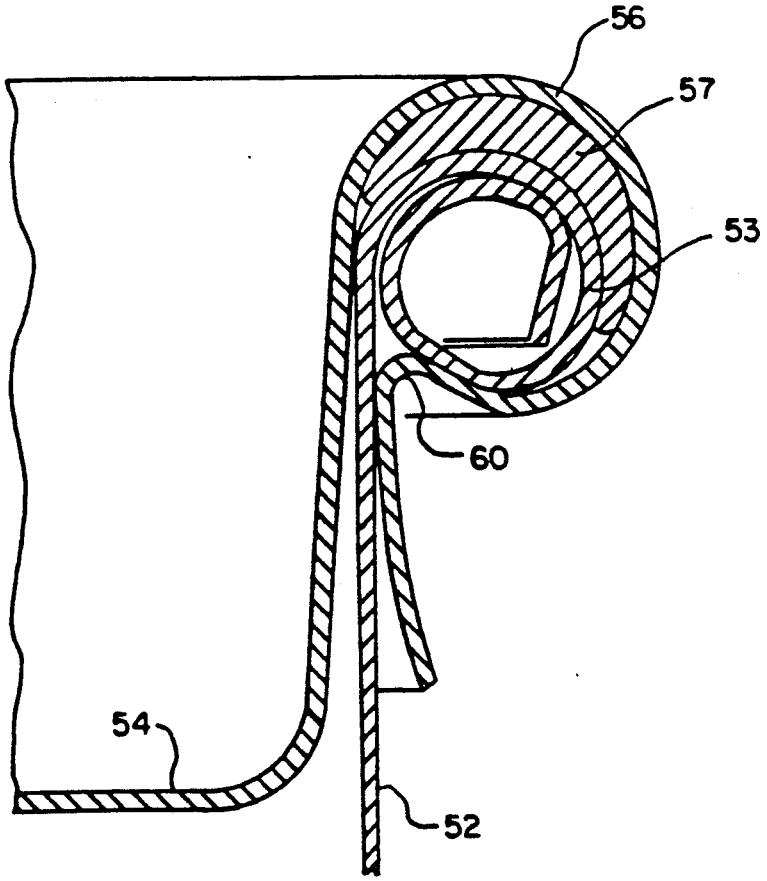

The width of the gap (78) is determined such that when the lugs are clenched under the curl of the pail forming the re-entrant angle (60) as shown in FIGS. 8 to 10, the side edges (77) of adjacent lugs are spaced closely adjacent one another or just touching one another. In this way the amount of metal in the crimped lugs beneath the curl (53) is maximised to provide the greatest possible mechanical grip of the cover on the rim of the pail.

We claim:

1. A cylindrical open head sheet metal pail or drum having a top rim formed as an outwardly rolled curl wherein the upper peripheral edge of the sheet metal has been curled or rolled outwardly, wherein the curl comprises two components, namely primary curl adjacent the peripheral edge and a secondary curl of larger cross-sectional diameter extending from the primary curl to the cylindrical wall of the pail or drum, the primary curl being curled through at least 180 degrees and the secondary curl through at least 270 degrees, wherein the primary curl touches and follows along the curve of the inside of the uppermost portion of the secondary curl and wherein the curl is generally oval in cross-sectional configuration having a height, generally parallel to the axis of the pail or drum, greater than the width, generally along the diameter of the pail.

2. A pail or drum as claimed in claim 1 wherein the height to width ratio of the curl is approximately 5 to 4.

3. A pail or drum as claimed in claim 1 when provided with a lid having a deeply recessed central portion, wherein when the lid is placed on the pail or drum the central portion of the lid is located significantly below the lower edge of the curl.

4. A pail or drum as claimed in claim 3 wherein the central portion of the lid is recessed by an amount between seventeen and twenty-five millimeters below the rim of the lid.

5. A pail or drum as claimed in claim 3 wherein the central portion of the lid is recessed by an amount between nineteen and twenty-two millimeters below the rim of the lid.

6. A pail or drum as claimed in claim 3 when provided with a lid having a recessed central portion, wherein an annular groove is provided in the lid spaced inwardly from the cylindrical wall of the pail or drum.

7. A pail or drum as claimed in claim 3 wherein the lid incorporates a plurality of lugs extending from the periphery of the lid adapted to be clenched beneath the rim of a pail or drum, characterized by the shape of each lug incorporating substantially parallel side edges.

8. A pail or drum as claimed in claim 7 wherein the gap between the side edges of adjacent lugs is determined such that adjacent side edges almost or completely abut after clenching beneath the rim of a pail or drum.

9. A pail or drum as claimed in claim 8 wherein eighteen to twenty-two lugs are provided around the periphery of the lid.

10. A pail or drum as claimed in claim 8 wherein twenty lugs are provided around the periphery of the lid.

11. A cylindrical open head sheet metal pail or drum having a top rim formed as an outwardly rolled curl wherein the upper peripheral edge of the sheet metal has been curled or rolled outwardly, wherein the curl comprises two components, namely primary curl adjacent the peripheral edge and a secondary curl of larger cross-sectional diameter extending from the primary curl to the cylindrical wall of the pail or drum, the primary curl being curled through at least 180 degrees and the secondary curl through at least 270 degrees, wherein the primary curl touches and follows along the curve of the inside of the uppermost portion of the secondary curl provided with a lid having a deeply recessed central portion, wherein when the lid is placed on the pail or drum the central portion of the lid is located significantly below the lower edge of the curl having a recessed central portion, wherein an annular groove is provided in the lid spaced inwardly from the cylindrical wall of the pail or drum.

12. A pail or drum as claimed in claim 11 wherein the central portion of the lid is recessed by an amount between seventeen and twenty-five millimeters below the rim of the lid.

13. A pail or drum as claimed in claim 11 wherein the central portion of the lid is recessed by an amount between nineteen and twenty-two millimeters below the rim of the lid.

14. A pail or drum as claimed in claim 11 wherein the lid incorporates a plurality of lugs extending from the periphery of the lid adapted to be clenched beneath the rim of a pail or drum, characterized by the shape of each lug incorporating substantially parallel side edges.

15. A pail or drum as claimed in claim 11 wherein the gap between the side edges of adjacent lugs is determined such that adjacent side edges almost or completely abut after clenching beneath the rim of a pail or drum.

16. A pail or drum as claimed in claim 15 wherein eighteen to twenty-two lugs are provided around the periphery of the lid.

17. A pail or drum as claimed in claim 16 wherein twenty lugs are provided around the periphery of the lid.

18. A cylindrical open head sheet metal pail or drum having a top rim formed as an outwardly rolled curl wherein the upper peripheral edge of the sheet metal has been curled or rolled outwardly through at least 450° with respect to the cylindrical wall of the pail or drum and wherein the curl does not contact any uncurled portion of the body of the pail or drum.

19. A cylindrical open head sheet metal pail or drum as claimed in claim 18, wherein the pail or drum is closed by a sheet metal lug cover lid incorporating a plurality of lugs extending downwardly from the periphery of the lid and wherein the curl is tightened by the clenching of the lugs beneath the top rim.

* * * * *